United States Patent [19]

Baud et al.

[11] Patent Number: 5,069,463

[45] Date of Patent: Dec. 3, 1991

[54] RELEASABLE BINDING ASSEMBLY

[75] Inventors: Philippe M. Baud, Barberaz; Frëdëric P. Bourgeois, Chambery, both of France

[73] Assignee: Salomon S.A., Annecy Cedex, France

[21] Appl. No.: 376,634

[22] Filed: Jul. 7, 1989

[30] Foreign Application Priority Data

Jul. 7, 1988 [FR] France ..... 88 05910

[51] Int. Cl.[5] ..... A63C 9/086

[52] U.S. Cl. ..... 280/14.2; 280/607; 280/636

[58] Field of Search ..... 280/607, 14.2, 633, 280/617, 618, 636

[56] References Cited

U.S. PATENT DOCUMENTS

| | | | |
|---|---|---|---|
| 4,652,007 | 3/1987 | Dennis | 280/618 |
| 4,792,155 | 12/1988 | Besnier | 280/607 |
| 4,844,502 | 7/1989 | Besnier | 280/607 |
| 4,869,522 | 9/1989 | Besnier et al. | 280/607 |
| 4,869,524 | 9/1989 | Bouque | 280/607 |

FOREIGN PATENT DOCUMENTS

| | | |
|---|---|---|
| 279687 | 12/1988 | Austria . |
| 391085 | 8/1990 | Austria . |
| 316050 | 5/1989 | European Pat. Off. . |
| 2595256 | 9/1987 | France . |
| 467081 | 2/1969 | Switzerland . |
| 8800076 | 1/1988 | World Int. Prop. O. . |
| 8903711 | 5/1989 | World Int. Prop. O. . |

OTHER PUBLICATIONS

A copy of the French Search Report.

*Primary Examiner*—Andres Kashnikow
*Assistant Examiner*—Eric Culbreth
*Attorney, Agent, or Firm*—Sandler, Greenblum & Bernstein

[57] ABSTRACT

A releasable binding assembly for a gliding board such as a monoski or snowboard which includes a pair of binding elements, each of which includes a mechanism for elastically retaining a shoe or boot and for releasing the shoe or boot upon the exertion of a biasing force exceeding a predetermined threshold. Each binding element includes a member which is movable against an elastic biasing force from an armed position in which a respective shoe or boot is retained on the board and a disarmed position in which the shoe or boot is permitted to be released. A linkage apparatus is provided so that upon release of one shoe or boot, the magnitude of the force which retains the other shoe or boot is reduced or eliminated to facilitate the release of the other shoe or boot.

28 Claims, 13 Drawing Sheets

RELEASABLE BINDING ASSEMBLY

BACKGROUND OF THE INVENTION

1. Field of the Invention

The present invention relates to a releasable binding assembly for retaining the shoes or boots of a skier on a single gliding board, particularly, but not exclusively, a snowboard or a monoski.

2. Discussion of Background Information

There are known bindings which are capable of retaining a shoe or boot on a gliding board, but which do not permit release. These bindings do not permit the skier to practice this sport in safety because, in case of a fall, the release of the shoes or boots is not possible, which can thus cause injury.

Releasable bindings are likewise known, particularly for a monoskis, which are capable of releasing a boot when it exerts a biasing force on the binding which exceeds a predetermined threshold. However, in such known bindings, there is no linkage between the bindings which retain the two boots so that one of the skier's shoes or boots can be held in place on the board, while the other has been previously released following an excessive bias. This also creates a dangerous situation for the skier because, in case of a fall, it is possible that a boot may remain attached to the monoski, possibly resulting in a foot or leg injury, particularly due to the relatively large weight of the board.

A releasable binding system is also disclosed in U.S. Pat. No. 4,652,007. An assembly is described therein including four conventional bindings, two front bindings and two rear bindings, which releasably retain intermediate plates which support the skier's boots. Between the two pairs of bindings for the two boots, a sliding plate is mounted. When one of the intermediate plates is released, the sliding plate is freed for movement, which increases the spacing between the two bindings which retain the remaining intermediate plate. As a result, the remaining intermediate plate is in turn permitted to be released from the board.

This device gives good results, but still has the disadvantage that the four binding elements must be aligned along a single axis. In addition, the release of an intermediate plate affects the spacing of the binding elements which retain the other intermediate plate, and does not affect the return force which retains the other intermediate plate on the board. In other words, the intermediate plate which is released last is not released by the opening of or by the disarming of the binding means which retain it.

Consequently, after release of the two feet, manual intervention is necessary to recenter the sliding plate, on the one hand, and to replace the bindings in the open position, ready to be put on, on the other hand.

In addition, if by accident the sliding plate does not move after release of a boot, the other boot will not be safely released.

SUMMARY OF THE INVENTION

In view of the problems and disadvantages described above with regard to known bindings, it is an object of the present invention to provide a releasable binding assembly for a gliding board including a pair of binding elements, each of which has a means for elastically retaining a shoe or boot and for releasing the shoe or boot upon the exertion of a biasing force exceeding a predetermined threshold, so that, as a consequence, the release of the other shoe or boot results.

In a particular aspect of the invention, the means for elastically retaining includes an elastic return device and plural members biased together against the force of the elastic return device, one of the members being movable between an activated armed position, in which the shoe or boot is elastically retained, and a disarmed position, in which the shoe or boot is permitted to be released, wherein, the disarmed position, the magnitude of the return force of the movable member is reduced for facilitating the release of the shoe or boot from its respective binding element.

In a further aspect of the invention, a linkage apparatus is provided for connecting each of the two binding elements to the other binding element, or to means associated therewith, for moving a respective binding element to the disarmed position upon the release of the shoe or boot from the respective binding element of the other shoe or boot.

In a still further aspect of the invention, each of the binding elements includes at least one compression spring for ensuring the elastic return of the movable member, a lever mounted for movement for compressing the spring for activating the movable member to the armed position. The linkage apparatus is operatively connected to the spring for reducing the compression of the spring in response to the release of the shoe or boot of the other binding element for activating its respective movable member to its disarmed position.

In a still further aspect of the invention, each of the binding elements includes a movable plate operatively connected to the lever, whereby movement of the lever moves the plate for compressing the spring. The binding assembly further includes a pawl for locking the lever in a position in which the spring is compressed. Further, the linkage apparatus can take the form of a cable having a first end connected to the pawl for moving the pawl to an open position upon a pulling force being exerted by the cable in response to the other shoe or boot being released, and to thereby free the lever and plate under the return bias of the at least one spring.

Still further according to the invention, each of the binding elements further includes a support for the movable member, and a second end of the cable is connected to the support of the movable member of the other respective binding element such that movement of the movable member of the other respective binding element toward the fixed member causes a pulling bias of the cable. Alternatively, the second end of the cable is operatively connected to the other respective shoe or boot.

In an alternate embodiment of the invention, a central housing is provided, within which the spring for each binding element is positioned substantially coaxially. An end of each spring is connected to the movable member of a respective binding element by a pulling means and another end of each spring rests against a slide housing which is translationally guided within the central housing. Further, a lever connects the slide housings so as to bring the slide housings closer to one another, in a closed position of the lever, and to maintain the housings joined against the return force of the springs.

Further according to this alternate embodiment, in the open position of the lever, the slide housings rest against the walls of the central housing.

In a further embodiment, the pulling means comprise tie rods. Alternatively, the pulling means can be a cable guided within a sheath.

In an additional aspect of the present invention, a pawl is provided for locking the lever in the closed position and a flexible tie is provided for operatively connecting the pawl to each of the shoes or boots such that a pulling force exerted by one of the flexible ties causes the opening of the pawl.

An additional aspect of the invention includes an intermediate plate for supporting each respective shoe or boot, each of the intermediate plates including a portion for engagement between the plural members of the elastic return device.

A further object of the invention is to provide a safety binding assembly for permitting the release of one's feet from a gliding board in which the assembly includes:

(a) a pair of binding elements each of which includes means for independently retaining a respective foot with respect to the board, each of the means for retaining including means for exerting an elastic biasing force of a first magnitude in an armed position of each respective binding element for retaining a foot on the board; and (b) means for reducing the magnitude of the elastic biasing force of each of the binding elements to thereby define a disarmed position of each respective binding element for facilitating release of a foot from its respective binding element upon release of the other foot from its respective binding element.

In a particular aspect of the invention, the pair of binding elements are configured to be arranged forwardly and rearwardly, respectively, on the board.

Further according to the invention, the means for reducing the magnitude of the elastic biasing force includes means for reducing the biasing force from the first magnitude to a second magnitude which is equal to, or substantially equal to, zero.

According to an additional aspect of the invention, the means for reducing the magnitude of the elastic biasing force includes means for linking one of the means for exerting an elastic biasing force of one of the binding elements to the other of the binding elements.

According to a still additional aspect of the invention, each of the binding elements further includes means for supporting a foot, wherein the means for reducing the magnitude of the elastic biasing force includes means for linking one of the means for exerting an elastic biasing force of one of the binding elements to one of the means for supporting a foot.

In a still further aspect of the invention, the means for exerting an elastic biasing force includes at least one spring and a member which is movable against an elastic biasing force of the spring which is adapted to be operatively associated to a foot for retaining the foot on the board. The means for exerting an elastic biasing force further includes a fixed member against which the movable member is biased by the at least one spring.

In a still further aspect of the invention, each of the binding elements further includes means for engaging a foot for retaining same on the board, the foot engaging means including a projection to be positioned between the movable member and the fixed member in the armed position of the binding element.

Still further according to the invention, the means for exerting an elastic biasing force includes at least one compression spring, wherein each of the binding elements further includes a lever mounted for movement for compressing the spring for positioning the binding element in an armed position.

Additionally, the means for reducing the magnitude of the elastic biasing force includes means for linking each of the binding elements with a respective other of the binding elements. The linking means includes means operatively connected to its respective lever for permitting the respective lever to move under the biasing force of a spring as the respective binding element moves to a disarmed position in response to the release of the foot from the other of the binding elements.

Still further, each of the binding elements includes a plate which is movable against the biasing force of a spring in response to pivoting of a respective one of the levers for positioning a respective one of the binding elements in its armed position.

Still further according to the invention, means for locking the lever in a predetermined position in the armed position of its respective binding element is provided, wherein the linking means includes means for permitting the lever to move from the predetermined position upon release of the foot from the other of the binding elements In a particular embodiment, the linking means includes a cable and the locking means includes a pawl which engages the lever, wherein the cable is connected, at one end, to the pawl and, upon release of the foot from the other of the binding elements, the cable is pulled to move the pawl from engagement with the lever.

Additionally, each of the binding elements includes a support for a respective movable member and another end of the cable is connected to the respective movable member, whereby movement of the respective movable member causes a pulling force on the cable for moving the pawl of the other binding element from engagement with the lever of the other binding element for moving the other binding element to its disarmed position.

In an additional embodiment of the invention, a housing is located between the binding elements, a respective guided member is mounted within the housing for each of the binding elements, and the means for exerting an elastic biasing force includes a respective spring operatively connected to a respective guided member which is biased against the elastic force of a respective spring. A lever is mounted for movement for compressing the springs in the armed position of the binding elements.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

In view of the problems inherent in known binding apparatuses as described above, one of the objects of the present invention is to provide a releasable binding assembly for a gliding board in which, upon the release of one shoe or boot, following an excessive biasing force, the release of the other shoe or boot results.

Another object of the present invention is to provide a device which requires a limited number of maneuvers to make it ready for insertion of the shoes or boots after their release.

Another object of the invention is to provide a device in which the release of a boot exerts an action directly on the biasing force which retains the other shoe or boot.

Other objects and advantages of the invention will appear in the course of the following description.

The assembly of releasable bindings for a gliding board includes two individual binding elements, each binding element having elastic retention means adapted to retain one of the user's feet and to release the foot when it exerts, on its binding element, a bias exceeding a predetermined threshold. These two binding elements operate by engaging a portion of the shoe or boot, or an intermediate plate mounted on the shoe or boot. One of the binding elements is able to be activated between an armed position, in which the retention means elastically retains the shoe or boot, and a disarmed position, in which the retention means permits the release of the shoe or boot. In the armed position, the binding element is elastically biased in the direction of the other binding element against the return force of an elastic return device. In the disarmed position, the return force of the movable binding element is either small or nil.

In the assembly according to the invention, the linkage means which connects each individual binding element to the other element, that is, the other shoe or boot or the other individual binding element itself, activates the movable retention means to place the binding element in a disarmed position, when the other boot is released by the individual binding element which retains it.

Figure 1:
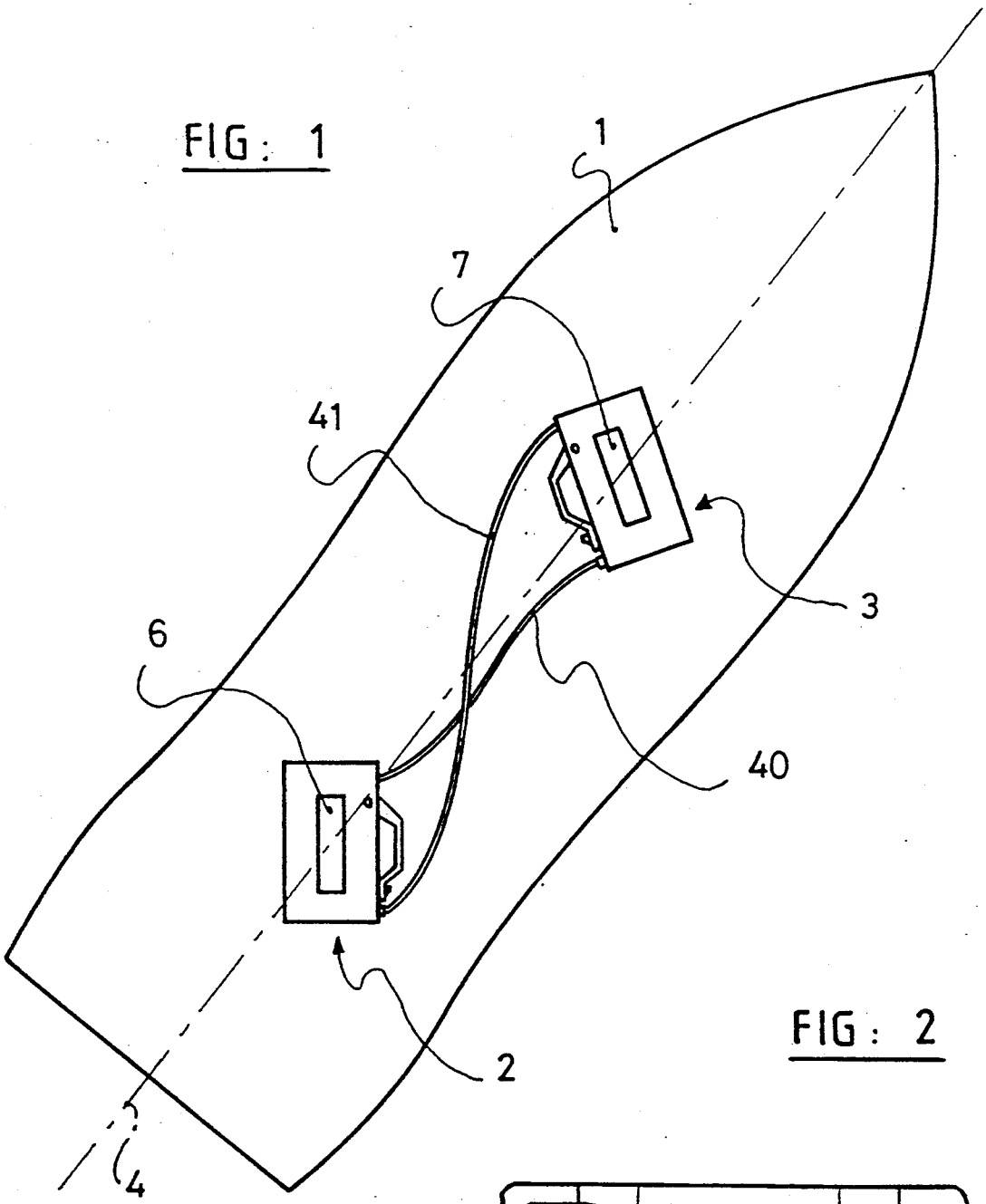
FIG. 1 illustrates a general plan view of a snow board equipped with two individual binding elements, and linkage means.

The gliding board 1 shown in FIG. 1 is a snow surf board, or "snowboard". The present invention also applies to other gliding boards on which the two feet of the skier are held in place, for example, a monoski in which the two feet of the skier are held in place side-by side.

Two individual binding elements 2 and 3 are affixed to the board 1 by any appropriate means, such as by screws. The binding elements 2 and 3 are adapted to retain the rear and front shoes or boots of the skier, respectively, on the board.

As is known, the individual binding elements 2 and 3 can be mounted on the board according to variable orientations. Preferably, they are aligned on the longitudinal axis 4 of the board 1, but the invention is not limited to this configuration.

In the illustrated embodiment of the invention, each individual element is presented in the form of a parallelepiped housing 5 whose upper surface has an opening, which are identified in FIG. 1 as openings 6 and 7 for elements 2 and 3, respectively.

Figure 2:
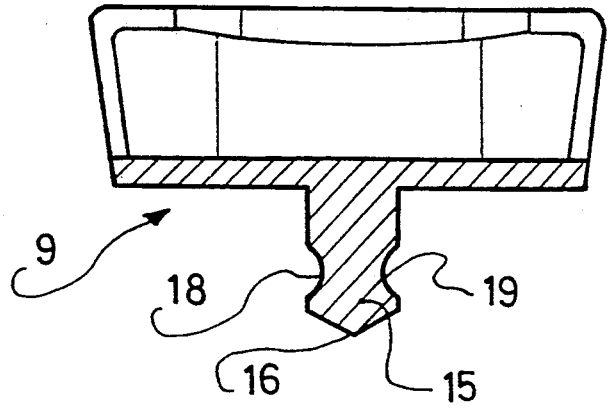
FIG. 2 illustrates, in transverse section, an end elevation view of an intermediate plate for supporting a shoe or boot.
Figure 3:
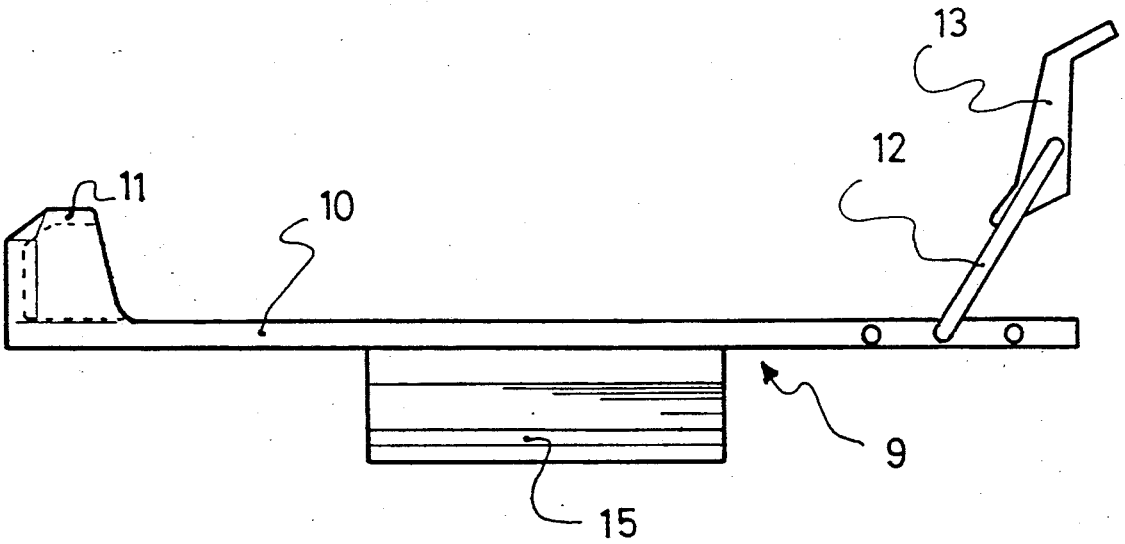
FIG. 3 illustrates a side elevation view of the intermediate plate of FIG. 2.

The individual elements 2 and 3 are adapted to retain intermediate plates 9 on the board 1, as shown in the FIGS. 2 and 3. Each intermediate plate 9 includes a support plate 10, on which the shoe or boot is placed, which is equipped, moreover, with conventional retention means for the shoe or boot, for example a front stirrup 11 and a rear spur 12 and lever 13 for solidly affixing the shoe or boot thereto.

A projection 15 extends downwardly from the median zone of the support plate 10 of the intermediate plate 9. As shown in FIG. 2, the projection 15 has, in transverse section, a pointed end 16 and depressions 18 and 19 on either side which preferably have a partially cylindrical shape so that the width of the projection is thereby reduced.

Each of the skier's boots is adapted to be retained in an individual binding element 2 or 3 by an intermediate plate, in the form of plate 9, the projections 15 of the intermediate plates being engaged within respective openings 6 and 7.

Figure 4:
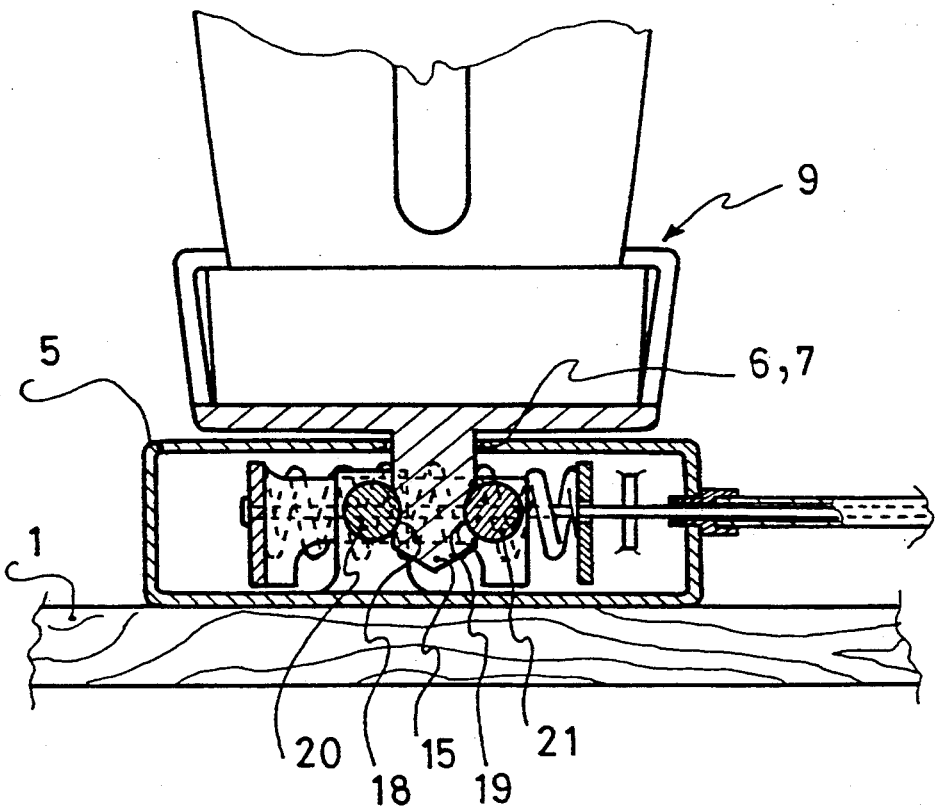
FIG. 4 illustrates, in transverse section, an individual binding element, in the normal ski position.

As shown in FIG. 4, each individual binding element comprises, within its housing 5, two rollers 20 and 21 which are adapted to be engaged in openings 18 and 19 of the projection 15, thus ensuring the retention of the projection and the intermediate plate 9. The radius of curvature of the rollers 20 and 21 is preferably less than or equal to the radius of curvature of openings 18 and 19.

The rollers 20 and 21 are mounted in rotation around respective axes. However, this is not limiting, and the rollers could be replaced by abutments each having a shape complementary to openings 18 and 19.

Figure 5:
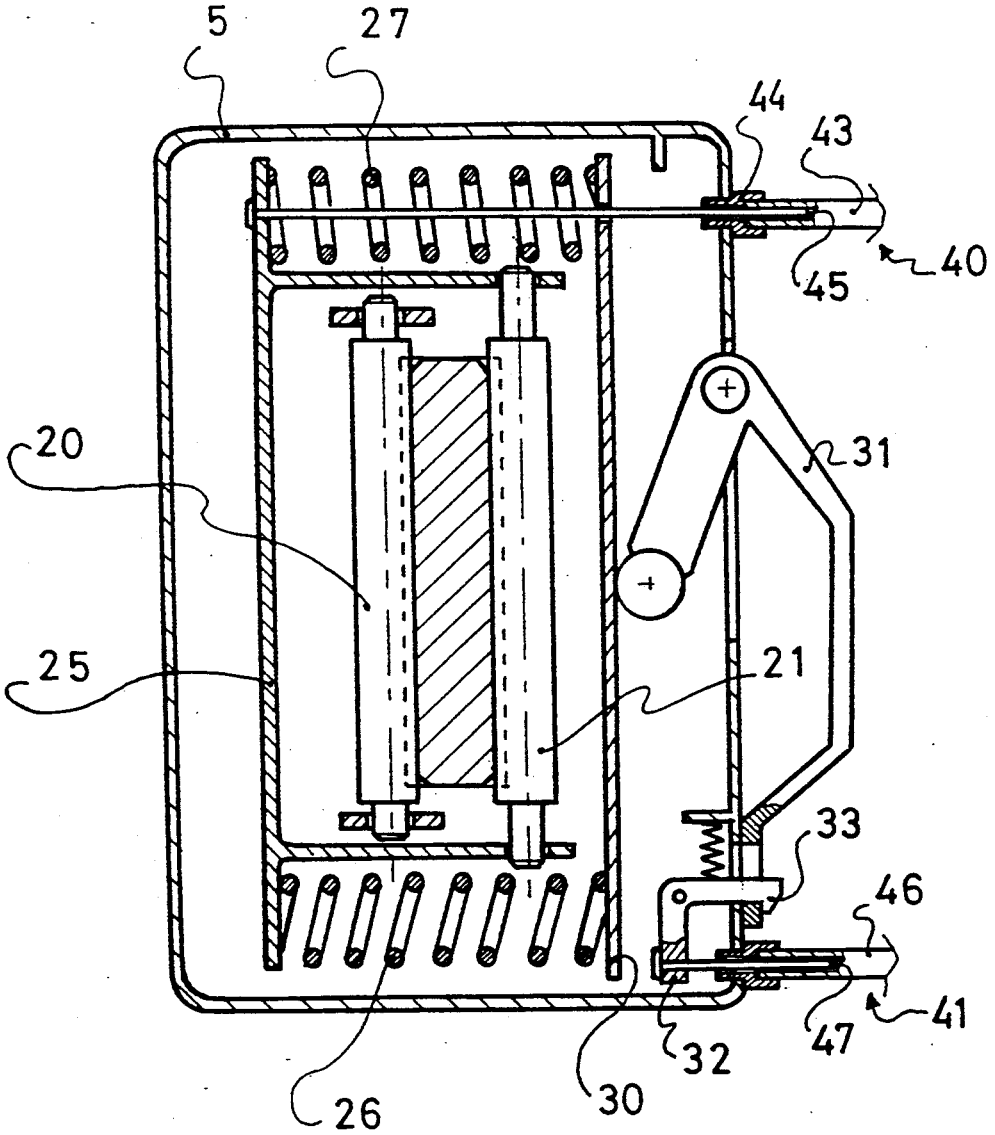
FIG. 5 illustrates, in plan view, and in partial section, the binding element of FIG. 4.

Preferably, as shown in FIG. 5, the axis of one of the rollers, for example roller 20, is fixedly mounted with respect to housing 5, and the axis of the other roller 21 is movable in a horizontal plane, the separation of rollers 20 and 21 causing the release of the projection 15, and thus of the shoe or boot from the board.

The movable roller 21 is mounted on a support carriage 25, which is guided within housing 5. Springs 26 and 27 are positioned at either end of roller 21 and have respective ends which engage and bias support 25 in a direction such that rollers 20 and 21 are biased toward each other. The other respective ends of springs 26 and 27 rest against a support plate 30 which is maneuvered by a lever 31.

Figure 8:
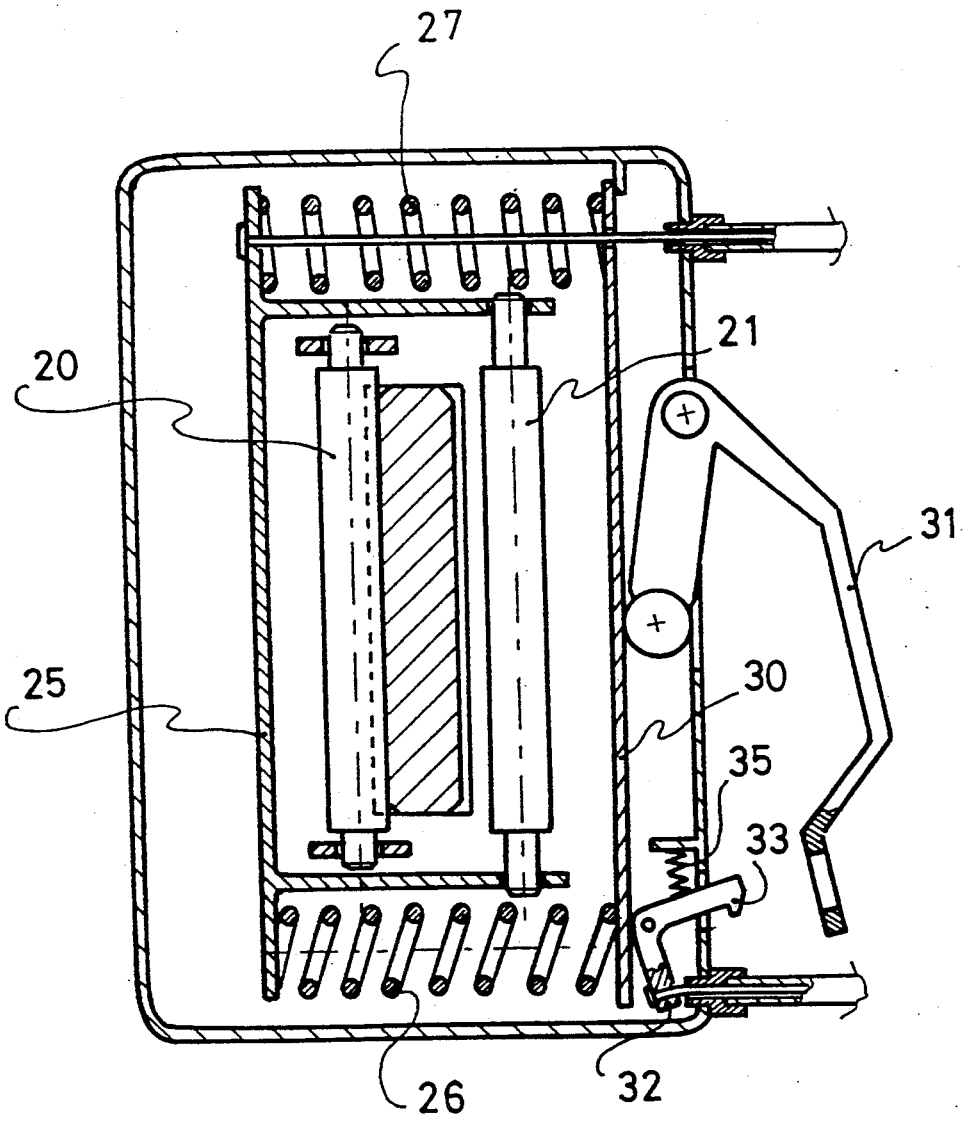
FIG. 8 illustrates, in plan view, and in partial section, the individual binding element in its position of FIG. 7.
Figure 10:
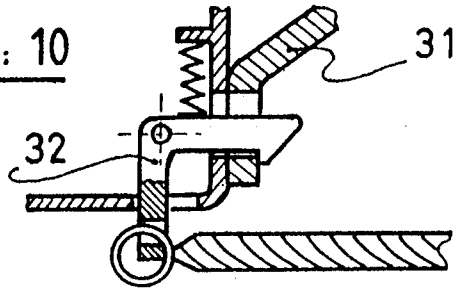
FIG. 10 illustrates a detail of construction of the device of FIG. 9.

The lever 31 is movable between a closed position, illustrated in FIG. 5, and an open position, illustrated in FIG. 8. In its closed position, lever 31 exerts a thrust on the support plate 30 which causes an elastic bias of roller 21 in the direction of roller 20, by means of support 25 and springs 26 and 27. The movable roller 21 and its respective binding element is then in an armed position.

In this armed, or closed, position, lever 31 is held in place by a pivoted pawl 32 which has a hooked end 33 to retain the end of lever 31.

In the open position of the lever, shown in FIG. 8, the action of spring 26 and 27 causes the separation of the support carriage 25 and the plate 30. This further causes the spacing of the roller 21 with respect to the roller 20. The movable roller 21 and binding element is then in a disarmed position.

To attain the open position of FIG. 8, pawl 32 pivots such that its hooked end 33 frees the lever 31. Preferably, a spring 35 is provided to return the pawl 32 to its initial position shown in FIG. 5.

The two individual binding elements 2 and 3 are connected by linkage means which, as shown in the embodiment of FIG. 1, are in the form of two flexible and inextensible linkage elements 40 and 41. Each of these elements is, for example, a flexible cable guided within a sheath.

The linkage element 40 connects the support carriage 25 of the binding element 2 to the pawl 32 of the binding element 3. Conversely, the linkage element 41 connects the support carriage 25 of the binding element 3 to the pawl 32 of binding element 2.

FIG. 5 illustrates the ends of the two linkage elements in connection with a binding element. Thus, for linkage element 40, the sheath 43 is retained in the wall of housing 5 by a sheath stop 44. The cable 45, guided within sheath 43, extends through the wall of housing 5, through the support plate 30, through the spring 27, and finally, it is fastened at its end, by a headed member, e.g., on the support carriage 25.

On the other side, in the same manner, the sheath 46 of linkage element 41 is retained at the wall of housing 5. The end of the cable 47 is fastened on pawl 32 such that a force on cable 47 towards the exterior of the housing causes the pivoting and opening of pawl 32 to release the lever 31.

As shown in FIG. 4, in the normal practice of skiing, the two rollers 20 and 21 are biased towards one another by springs 26 and 27. With a relatively small force, intermediate plate 9 is freed from the binding element 2 or 3 which holds it.

Figure 6:
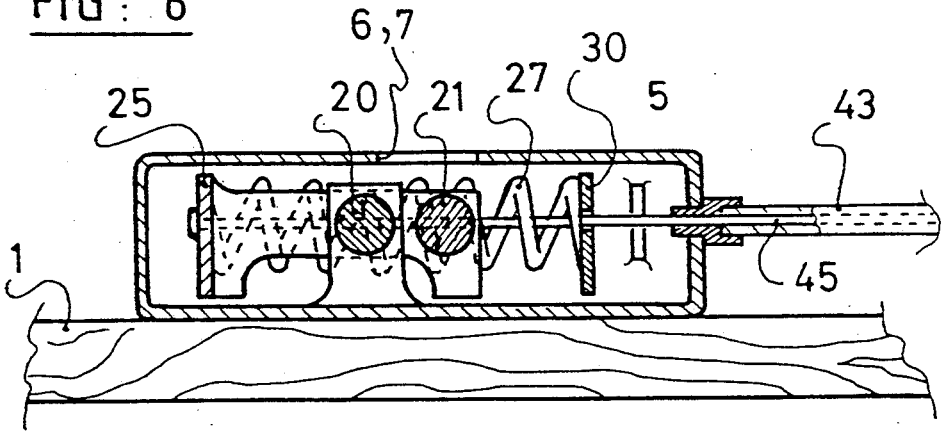
FIG. 6 illustrates the binding element of FIG. 5, after release of the shoe or boot while skiing, for example; binding of FIG. 4 after release of the other shoe or boot.

FIG. 6 illustrates a binding element after an accidental release of the shoe or boot and the intermediate plate from the position shown in FIG. 4. As can be seen in FIG. 6, in the absence of projection 15, roller 21 tends to approach roller 20, which further causes the displacement of support carriage 25 towards the left. Furthermore, this movement causes the cable to be pulled. This opens pawl 32 of the other binding element, and releases the other shoe or boot in the same manner as that which will be explained with respect to FIG. 7.

Figure 7:
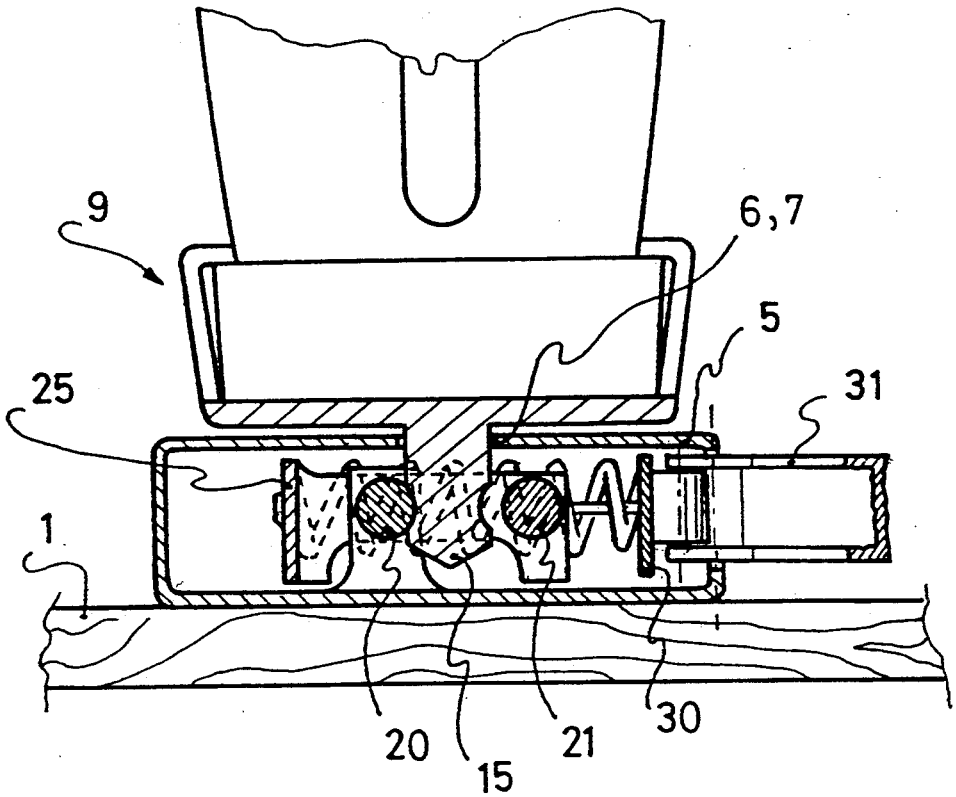
FIG. 7 illustrates, in transverse section, the binding element in a position for release of the shoe or boot.

In FIG. 7 a binding element is shown in which the boot has been released by the other binding element. This release causes the pulling of cable 47 in a manner similar to that which was described above in connection with FIG. 6. This pulling opens pawl 32, thereby enabling the rocking of lever 31, as is shown in FIG. 8. Following the rocking of lever 31, plate 30 moves towards the right in FIG. 5, which then causes the springs 26 and 27 to move to a less compressed state. Roller 21 is biased in the direction of roller 20 by a force which decreases, and possibly, cancels itself out. As a result, with the least amount of force, plate 9 is freed from the individual binding element which retains it. Roller 21 is thus activated in the disarmed position of the binding element.

Thus, according to the present invention, the release of one of the shoes or boots leads to the release of the other shoe or boot by disarming the retention means which retains the other shoe or boot. Specifically, the elastic biasing force retaining the other shoe or boot is significantly reduced, which facilitates its release.

Figure 9:
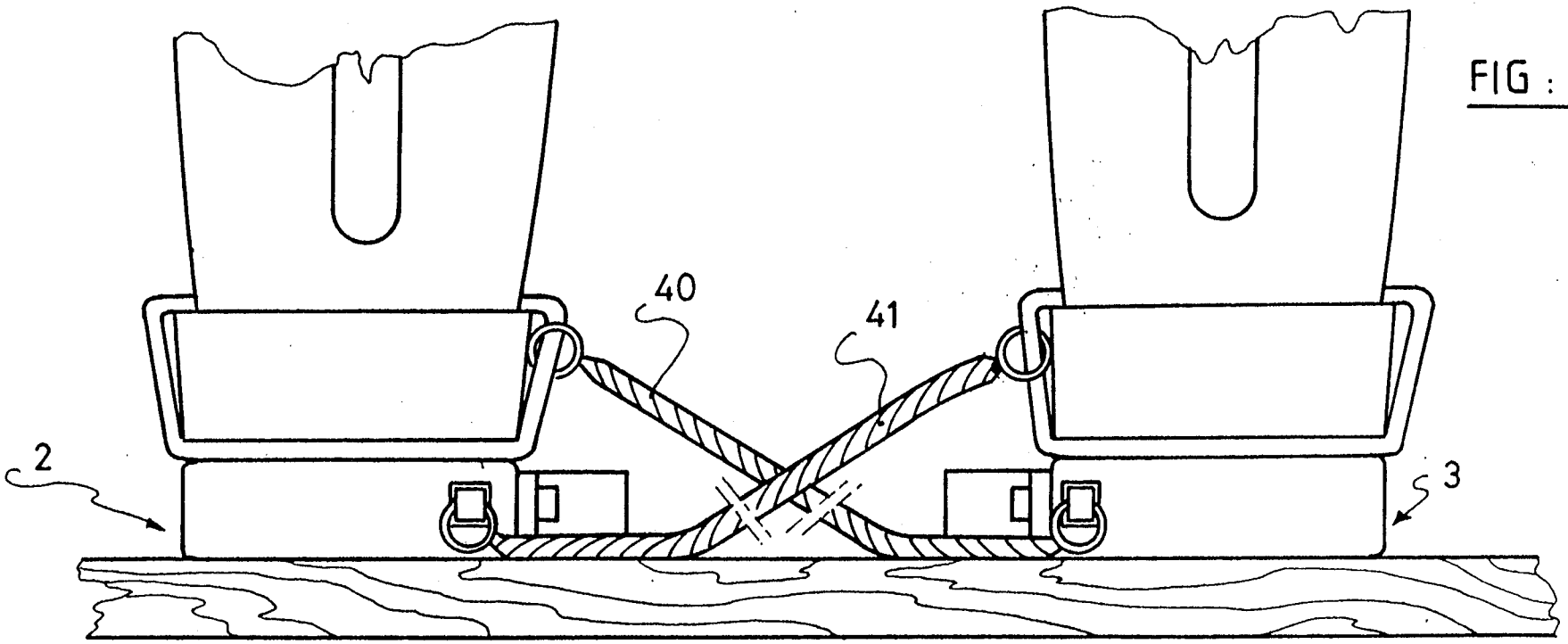
FIG. 9 illustrates an alternative embodiment.

FIG. 9 illustrates an alternative embodiment according to which the two linkage elements 40 and 41 constitute the linkage means, and connect, respectively, a pawl 32 of an individual binding element to the intermediate plate 9 of the other shoe or boot. In this manner, when a shoe or boot is released by its intermediate binding element, it causes a tension of the linkage element 40 or 41 which is connected to it, and an opening of pawl 32 and lever 31 of the other binding element. In this manner, the other shoe or boot, in turn, is freed.

In addition, in this embodiment, the shoes or boots remain connected to the board by means of linkage elements 40 and 41, which prevents the board from pursuing its course alone in the case of a fall by the skier.

After an accidental release, in the embodiment of FIGS. 1–8, and in the alternative of FIG. 9, insertion is carried out by positioning the intermediate plates in their respective binding element, then by closing the levers 31 in the closed arming position, until they are locked by their respective pawl 32, which activates the movable roller 21 in the armed position of the binding element.

In the case where a single lever is open, after an accidental release, it is this lever that the user must close after positioning his or her shoes or boots.

The embodiment of FIG. 9 has the advantage that the shoes or boots can be reinserted in the binding elements 2 and 3 individually, i.e., one after the other. This presents an advantage, for example, in the waiting lines for mechanical lifts.

Figure 11:
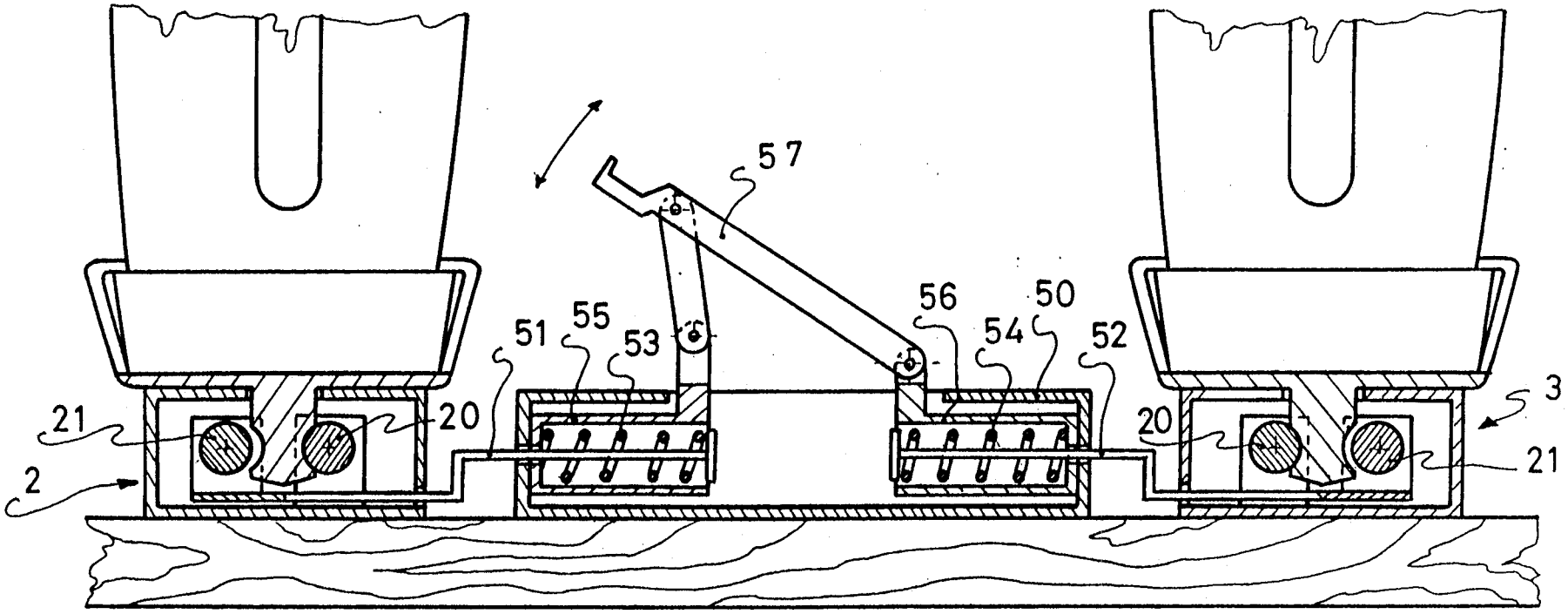
FIG. 11 illustrates another alternative embodiment.

FIG. 11 shows an alternative embodiment of the invention according to which the springs, which ensure the return of movable rollers 21 of the two individual binding elements 2 and 3, are positioned within a central housing 50.

As is shown in FIG. 11 the movable roller 21 of element 2 is connected by means of a tie rod 51 at the end of a compression spring 53. The displacement of the movable roller 21 away from fixed roller 20 produces a compression of spring 53. In the same manner, for element 3, the movable roller 21 is connected by a tie rod 52 to spring 54.

Figure 13:
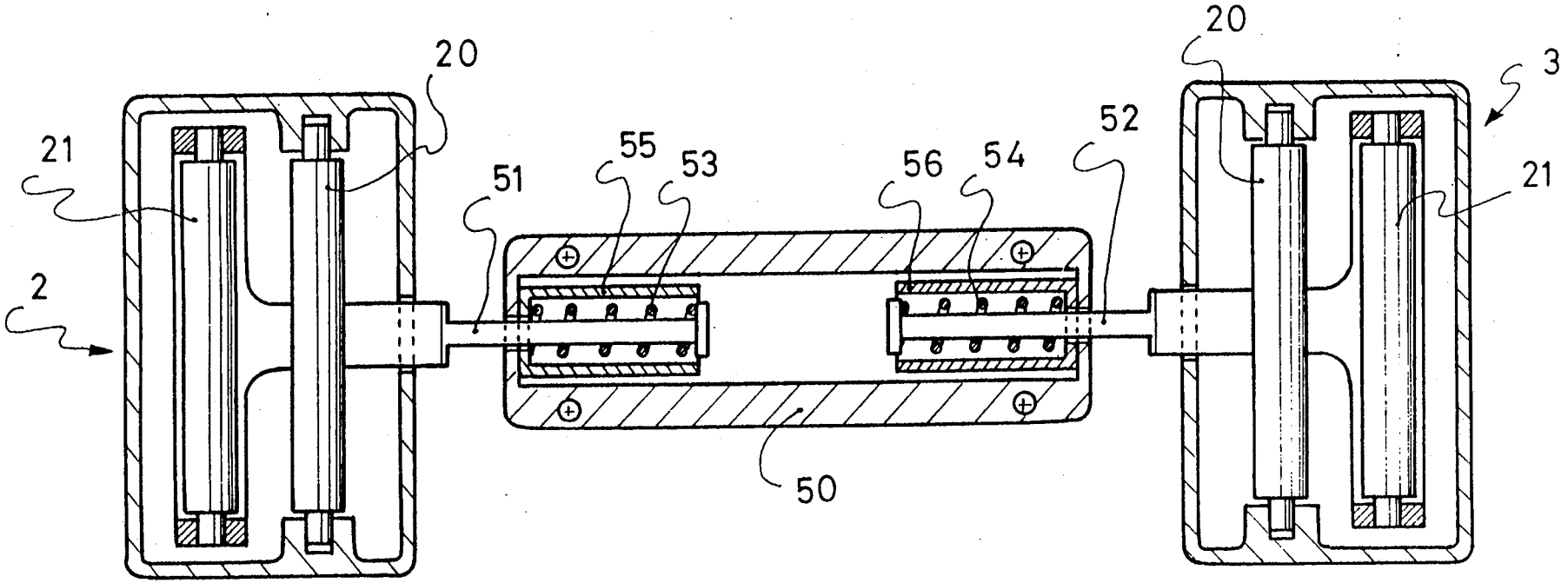
FIG. 13 illustrates, in plan view, and in partial section, the device of FIG. 11.

The two springs 53 and 54 are substantially co-axial and are positioned in a symmetrical manner, as shown in FIGS. 11 and 13. In addition, the interior ends of spring 53 and 54 which are biased, respectively, by tie rods 51 and 52, in such a fashion that the displacement of roller 21 from roller 20 in either of the binding elements 2 or 3, produces a compression of spring 53 or 54 by which it is connected by tie rods 51 and 52, respectively.

Furthermore, within central housing 50 are positioned two movable slide housings 55 and 56 which are guided translationally along the direction defined by the axis of the springs. The exterior end of each spring 53 and 54 rests against a slide housing 55 and 56, respectively. The slide housings can be brought closer to one another by a lever 57 which works in the manner of a toggle joint. This coming together of the two slide housings 55 and 56 occurs against the return force of the two spring 53 and 54.

FIG. 11 shows the device in the disarmed position, lever 57 being in the open position. In this position, springs 53 and 54 push the two slide housings 55 and 56 on each side, and to the bottom of housing 50. The two movable rollers 21 are in the disarmed position.

Figure 12:
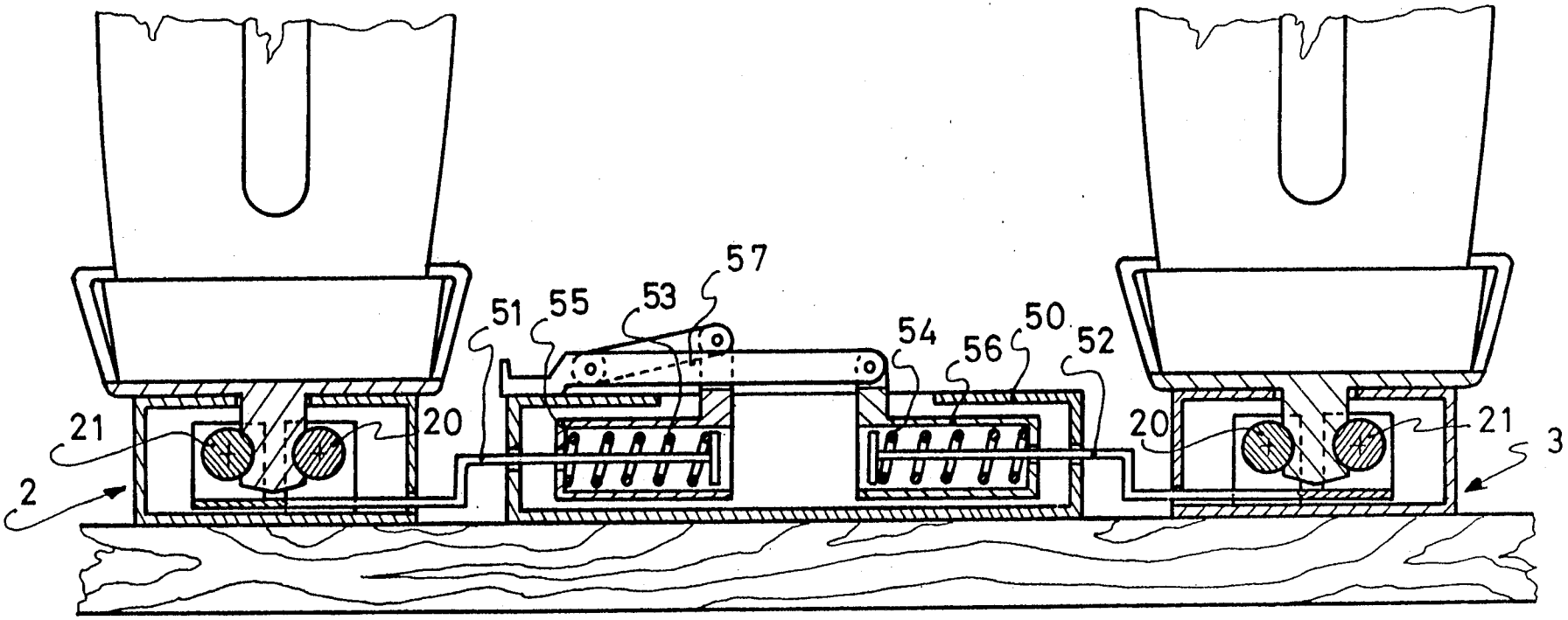
FIG. 12 illustrates the device of FIG. 11 in the normal ski position.

FIG. 12 shows the device in the normal skiing position. In this position, the toggle joint formed by lever 57 is closed, which causes the coming together of the two slide housings 55 and 56. The two springs 53 and 54 are compressed, which elastically biases the movable rollers 21 of the two binding elements 2 and 3 in the direction of their respective fixed roller. The movable rollers 21 are activated in FIG. 12 in the armed position.

In the armed position of FIG. 12, the two slide housings 55 and 56 form, with lever 57, a rigid assembly in the direction defined by the axis of the springs.

Figures 14, 15:
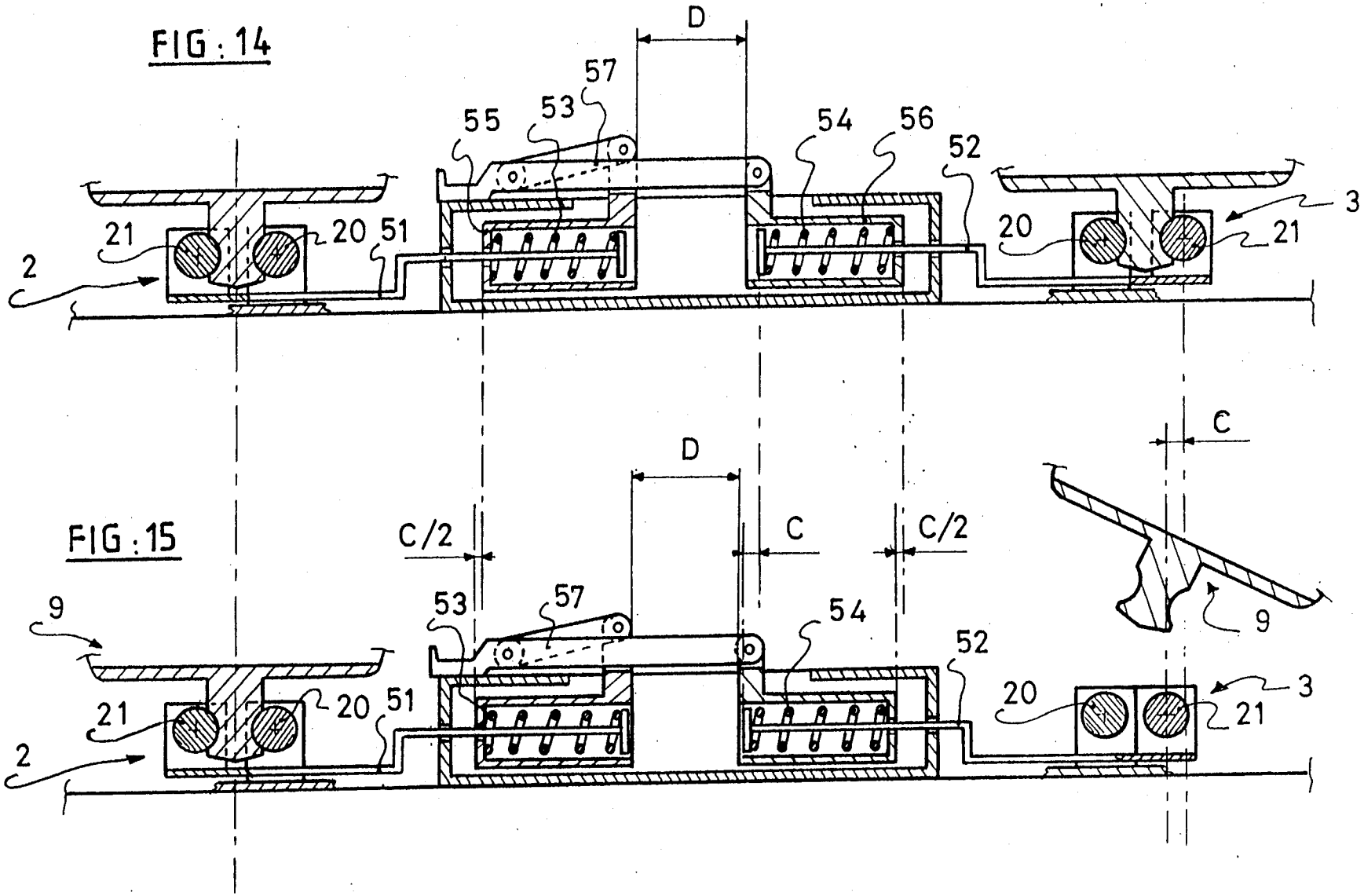
FIGS. 14 and 15 illustrate the operation of the device of FIGS. 11-13.

FIG. 14 schematically illustrates the assembly of bindings in the normal ski position. The two slide housings 55 and 56 are kept apart from one another of a distance D, and the two springs 53 and 54 tend to move them away from one another.

FIG. 15 illustrates the case where one of the intermediate plates 9, for example that of element 3, is freed. In this case, the movable roller 21 of element 3 approaches the fixed roller by a distance C. This coming together makes it possible for each spring 53, 54 to relax by a distance C/2, which further causes the disarming of the movable roller 21 of the other binding element 2. The intermediate plate 9 of this other element 2 can then be released following a very weak bias.

To resecure one's feet to the board, following an accidental fall, the skier need only open lever 57, i.e., place it in the position of FIG. 11, to engage the two projections of the intermediate plates 9 in their respective binding element, and to then place the lever 57 in the closed position of FIG. 12. In the preferred embodiment shown, the closed position of lever 57 is a stable position.

Figure 16:
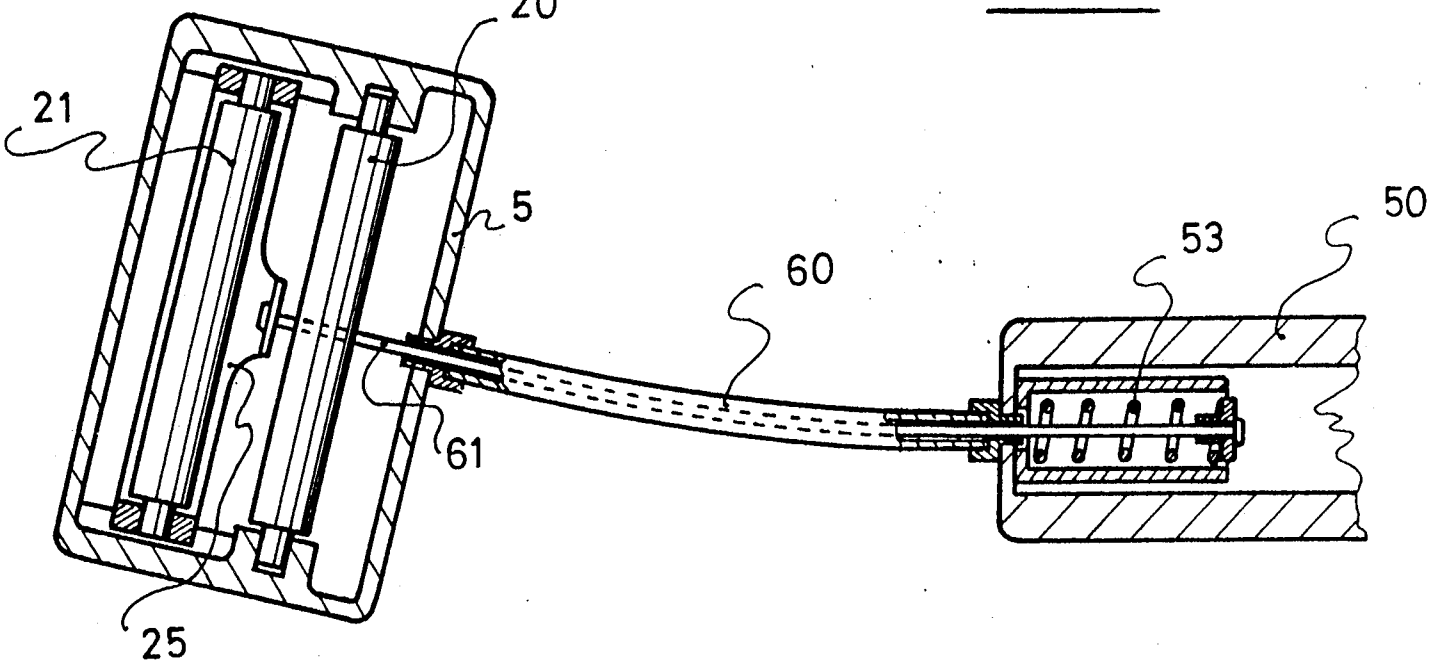
FIG. 16 illustrates a further alternative embodiment.
Figure 18:
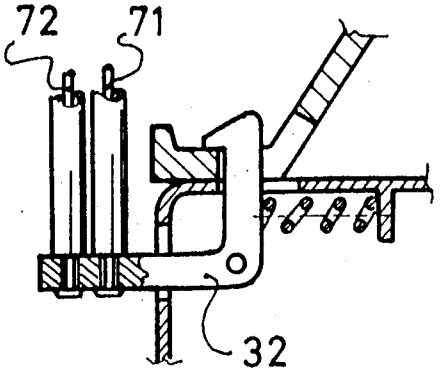
FIG. 18 illustrates a detail of the embodiment of FIG. 17.

FIG. 16 shows an alternative embodiment according to which the tie rods 51 and 52 are replaced by flexible linkage elements. Thus, FIG. 16 shows a cable 61 which connects the support 25 of the movable roller 21 to the interior end of its return spring 53, the cable being furthermore guided within a flexible sheath 60 between the outlet of housing 5 of the binding element and the inlet of central housing 50. Only one part of the binding assembly is shown in FIG. 16.

Figure 17:
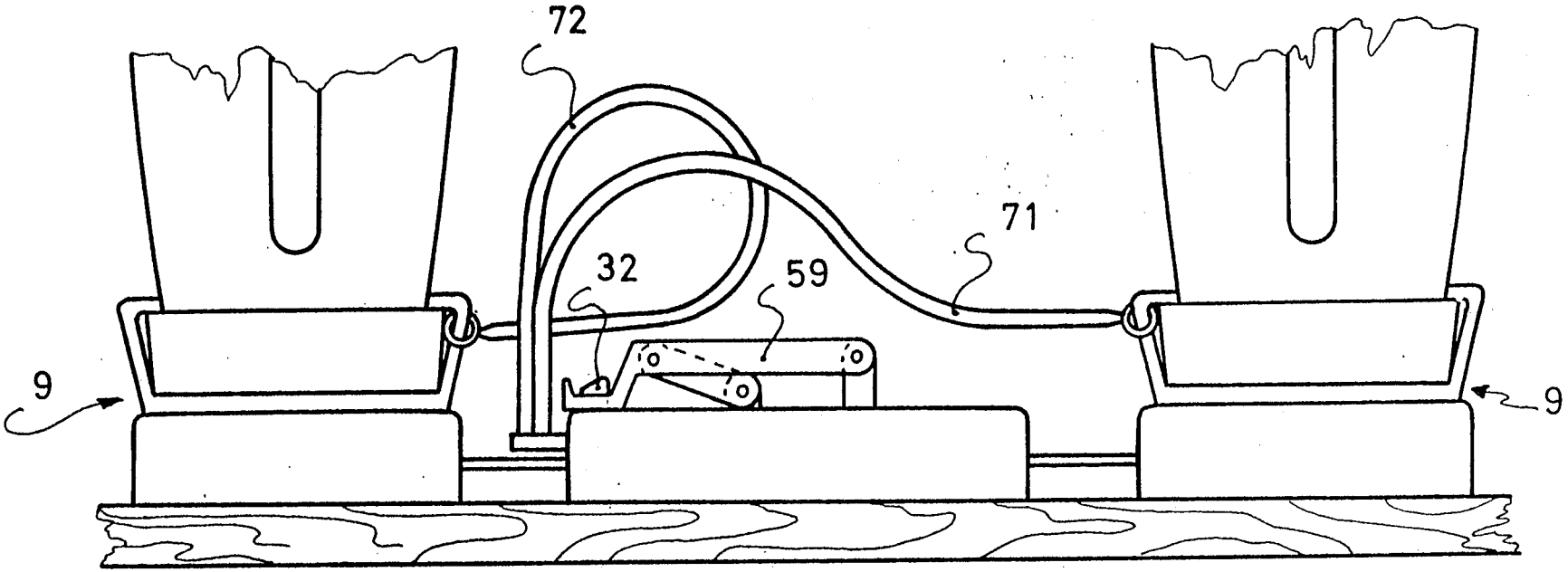
FIG. 17 illustrates a still further alternative embodiment.

FIG. 17 shows another alternative embodiment according to which lever 59 is locked by a pawl 32 similar to that which was described relative to FIG. 5. Contrary to the preceding case, the closed position of the lever is an unstable position, and it is the pawl 32 which ensures its locking in the closed position. Furthermore, a flexible tie 71, 72 connects each intermediate plate 9 to pawl 32. In this fashion, in case of an accidental fall, and release of one of the intermediate plates 9, not only the retention means which retains the other intermediate plate is disarmed, but even by means of one or another of cables 71, 72, the lever 59 for removal is also activated in the open position, following the rocking of pawl 32 in the opening direction.

It is to be noted that, in this case, the flexible ties 71 and 72 still connect the feet of the skier to the board, after the fall of the skier, which can prevent the board from pursuing its course alone away from the skier.

Figure 19:
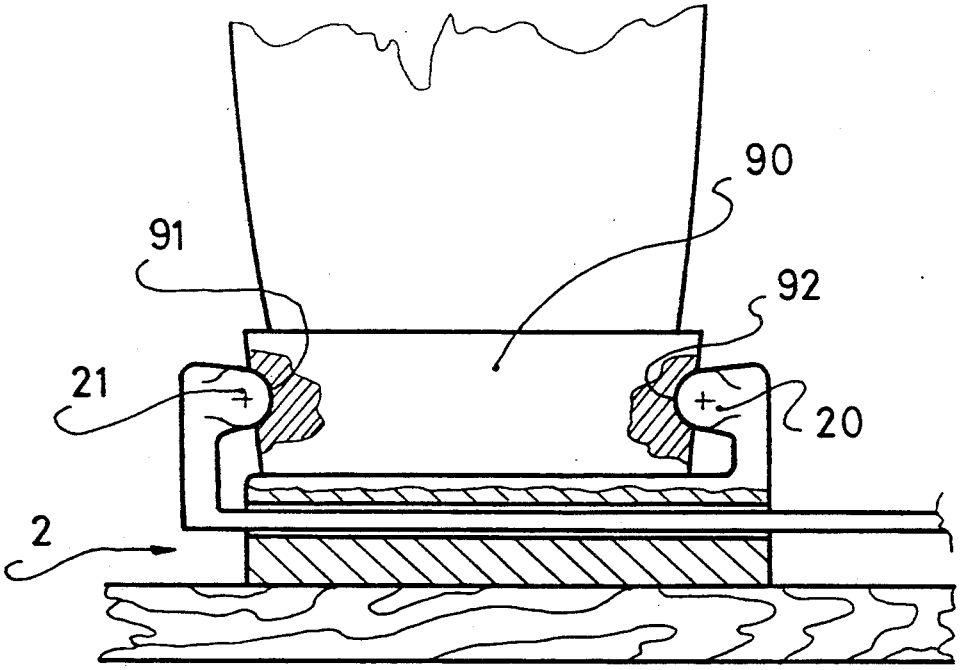
FIG. 19 illustrates another embodiment in which the shoe or boot is retained in a similar manner to that of the foregoing embodiments but without the use of an intermediate plate.

FIG. 19 shows an alternative embodiment according to which it is the boot itself which is retained between a fixed abutment 20 and a movable abutment 21, respectively.

These abutments retain the sole of shoe or boot 90, at the position of openings 91 and 92, similar to openings 18 and 19 of the intermediate plate 9 of the preceding embodiments. The difference with previously described embodiments is that the initial spacing of abutments 20 and 21 is more significant in the FIG. 19 embodiment since it corresponds substantially to the width of a shoe or boot sole. On the other hand, the principle of operation is unchanged.

Although the present invention has been described with respect to specific embodiments, the embodiments are to be considered merely illustrative only and not restrictive, various modifications being possible without departing from the scope of the present invention which is defined by the following claims.

What is claimed is:

1. A releasable binding assembly for a gliding board comprising:

two binding elements, each binding element having a means for elastically retaining a shoe or boot and for releasing said shoe or boot upon the exertion of a biasing force exceeding a predetermined threshold, said means for elastically retaining comprising an elastic return device and plural members biased together against an elastic return force of said elastic return device, one of said members being movable between an activated armed position, in which the shoe or boot is elastically retained by said elastic return force being applied against said movable member, and a disarmed position, in which the shoe or boot is permitted to be released, wherein, in said disarmed position, said elastic return force applied against said movable member has a reduced magnitude for facilitating the release of said shoe or boot from its respective binding element, said binding assembly further comprising means for operatively connecting each of said two binding elements to the other binding element, wherein said means for connecting moves said movable member of a respective binding element to said disarmed position upon the release of the shoe or boot from the respective binding element of the other shoe or boot.

2. The binding assembly of claim 1, wherein each of said binding elements comprises at least one compression spring for ensuring the elastic return of said movable member, said assembly further comprising a lever mounted at a pivot axis, which is adapted to be fixed relative to the gliding board, for movement for compressing said at least one spring for activating said movable member to said armed position, and wherein said means for connecting said binding elements are operatively connected to said at least one spring for reducing the compression of said at least one spring in response to the release of the shoe or boot of the other binding element for activating its respective movable member to its disarmed position.

3. The binding assembly of claim 2, wherein each of said binding elements comprises a movable plate operatively connected to said lever, whereby movement of said lever moves said plate for compressing said at least one spring, said binding assembly further comprising a pawl for locking said lever in a position in which said at least one spring is compressed, wherein said means for connecting comprises a cable having a first end connected to said pawl for moving said pawl to an open position upon a pulling force exerted by said cable in response to the other shoe or boot being released, and to thereby free said lever and plate under the return bias of said at least one spring.

4. The binding assembly of claim 3, wherein each of said binding elements further comprises a support for said movable member, wherein a second end of said cable is connected to said support of said movable member of the other respective binding element such that movement of said movable member of the other respective binding element toward the fixed member causes a pulling bias of said cable.

5. The binding assembly of claim 3, the other respective end of said cable is operatively connected to the other respective shoe or boot.

6. The binding assembly of claim 2, further comprising a central housing, wherein said at least one spring of each binding element is positioned in said central housing substantially coaxially with respect to each other, wherein an end of each spring is connected to said movable member of a respective binding element by a pulling means and wherein another end of each spring rests against a slide housing translationally guided within said central housing, and a lever connecting said slide housing so as to bring said slide housings closer to one another, in a closed position of said lever, and to maintain said housings joined against the return force of said springs.

7. The binding assembly of claim 6, wherein in said open position of said lever, the slide housings rest against predetermined surfaces of said central housing.

8. The binding assembly of claim 6, wherein each said pulling means comprises a tie rod.

9. The binding assembly of claim 6, wherein each said pulling means comprises a cable guided within a sheath.

10. The binding assembly of claim 6, further comprising a pawl for locking said lever in said closed position, a flexible tie for operatively connecting said pawl to each of the shoes or boots such that a pulling force exerted by one of said flexible ties causes the opening of said pawl.

11. The binding assembly of claim 1, further comprising an intermediate plate for supporting each respective shoe or boot, each said intermediate plate comprising a portion for engagement between said plural members of said elastic return device.

12. A safety binding assembly for a gliding board comprising:

(a) a pair of binding elements each of which includes means for retaining a respective foot with respect to said board, independently of the other respective binding element each of said means for retaining comprising means for exerting an elastic biasing force of a first magnitude in an armed position of each respective binding element for retaining a foot on said board; and (b) means for reducing said elastic biasing force of each of said binding elements from said first magnitude to thereby define a disarmed position of each respective binding element for facilitating release of a foot from its respective binding element upon release of the other foot from its respective binding element.

13. The safety binding assembly of claim 12, wherein said pair of binding elements are configured to be arranged forwardly and rearwardly, respectively, on said board.

14. The safety binding assembly of claim 12, wherein said safety means for reducing the magnitude of said elastic biasing force comprises means for reducing said biasing force from said first magnitude to a second magnitude which is approximately equal to zero.

15. The safety binding assembly of claim 12, wherein said means for reducing the magnitude of said elastic biasing force comprises means for linking one of said means for exerting an elastic biasing force of one of said binding elements to the other of said binding elements.

16. The safety binding assembly of claim 12, further comprising means for supporting a foot associated with each of said binding elements, wherein said means for reducing the magnitude of said elastic biasing force comprises means for linking one of said means for exerting an elastic biasing force of one of said binding elements to one of said means for supporting a foot.

17. The safety binding assembly of claim 12, wherein said means for exerting an elastic biasing force comprises at least one spring and a member which is movable against an elastic biasing force of said at least one spring which is adapted to be operatively associated to a foot for retaining said foot on said board.

18. The safety binding assembly of claim 17, wherein said means for exerting an elastic biasing force further comprises a fixed member against which said movable member is biased by said at least one spring.

19. The safety binding assembly of claim 18, further comprising means for supporting a foot, associated with each of said binding elements, for retaining the foot on said board, said foot engaging means comprising a projection to be positioned between said movable member and said fixed member in said armed position of said binding element.

20. The safety binding assembly of claim 12, wherein said means for exerting an elastic biasing force comprises at least one compression spring, wherein each of said binding elements further comprises means for compressing said at least one spring for positioning said binding element in an armed position.

21. The safety binding assembly of claim 20, wherein said means for compressing said at least one spring comprises a lever mounted for movement about a pivot axis which is adapted to be fixed relative to the gliding board.

22. The safety binding assembly of claim 21, wherein said means for reducing the magnitude of said elastic biasing force comprises means for linking each of said binding elements with a respective other of said binding elements, said linking means comprises means operatively connected to its respective lever for permitting said respective lever to move under the biasing force of said at least one spring as the respective binding element moves to a disarmed position in response to the release of the foot from the other of said binding elements.

23. The safety binding assembly of claim 22, wherein each of said binding elements further comprises a movable plate which is movable a the biasing force of said at least one spring in response to pivoting of a respective one of said levers for positioning a respective one of said binding elements in its said armed position.

24. The safety binding assembly of claim 23, further comprising means for locking said lever in a predetermined position in said armed position of its respective binding element, wherein said linking means comprises means for permitting said lever to move from said predetermined position upon release of the foot from said other of said binding elements.

25. The safety binding assembly of claim 24, wherein said linking means comprises a cable and said locking means comprises a pawl which engages said lever, wherein said cable is connected, at one end, to said pawl and, upon release of the foot from said other of said binding elements said cable is pulled to move said pawl from engagement with said lever.

26. The safety binding assembly of claim 25, wherein each of said binding elements comprises support for a respective movable member and wherein another end of said cable is connected to said respective movable member, whereby movement of said respective movable member causes a pulling force on said cable for moving said pawl of the other binding element from engagement with said lever of the other binding element for moving the other binding element to its disarmed position.

27. The safety binding assembly of claim 12, further comprising a housing located between said binding elements, a respective guided member mounted within said housing for each of said binding elements, wherein said means for exerting an elastic biasing force comprises a respective spring operatively connected to a respective guided member which is biased against the elastic force of a respective spring, further comprising means for compressing said springs in said armed position of said binding elements.

28. The safety binding assembly of claim 27, wherein said means for compressing said at least one spring comprises a lever mounted for movement about a pivot axis which is adapted to be fixed relative to the gliding board.

* * * * *